US007561822B2

(12) United States Patent
Watanabe et al.

(10) Patent No.: US 7,561,822 B2
(45) Date of Patent: Jul. 14, 2009

(54) IMAGE FORMING APPARATUS WITH CASING HAVING METAL PLATES ON EACH PERIPHERAL SIDE

(75) Inventors: Koki Watanabe, Moriya (JP); Shinichiro Wakahara, Tokyo (JP); Jiro Shirakata, Kashiwa (JP); Koji Takematsu, Toride (JP); Shinichiro Hosoi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 11/252,608

(22) Filed: Oct. 19, 2005

(65) Prior Publication Data

US 2006/0088333 A1 Apr. 27, 2006

(30) Foreign Application Priority Data

Oct. 22, 2004 (JP) ..... 2004-308014

(51) Int. Cl.
*G03G 15/00* (2006.01)

(52) U.S. Cl. ..... 399/107; 399/88

(58) Field of Classification Search ..... 399/88, 399/90, 320, 335, 107; 219/619, 660
See application file for complete search history.

(56) References Cited

U.S. PATENT DOCUMENTS 5,615,085 A * 3/1997 Wakabayashi et al.
6,405,014 B2 * 6/2002 Takano et al.
6,501,662 B2 * 12/2002 Ikeda
6,799,002 B2 * 9/2004 Birumachi
6,969,833 B2 * 11/2005 Suzuki ..... 219/619
7,099,616 B2 8/2006 Kato et al. ..... 399/328
7,130,554 B2 10/2006 Takematsu ..... 399/69
7,303,346 B2 * 12/2007 Ogi et al.
2002/0005405 A1 * 1/2002 Sato et al. ..... 219/619
2002/0044788 A1 * 4/2002 Kawano et al.
2004/0009020 A1 1/2004 Shimizu et al.
2004/0035856 A1 2/2004 Shimizu et al.
2004/0226940 A1 11/2004 Monda et al.
2005/0180788 A1 8/2005 Watanabe et al. ..... 399/328
2006/0086721 A1 4/2006 Wakahara et al. ..... 219/619
2006/0086722 A1 4/2006 Takematsu et al. ..... 219/619
2006/0086725 A1 4/2006 Hosoi et al. ..... 219/619
2006/0086731 A1 4/2006 Shirakata et al. ..... 219/645
2006/0089314 A1 4/2006 Wakahara et al. ..... 514/21
2006/0138126 A1 6/2006 Watanabe ..... 219/619

(Continued)

FOREIGN PATENT DOCUMENTS

JP 62-150371 7/1987

(Continued)

OTHER PUBLICATIONS

Partial English Translation of Official Action mailed Jan. 6, 1009 in JP 2004-308014.

*Primary Examiner*—Susan S Lee
(74) *Attorney, Agent, or Firm*—Fitzpatrick, Cella, Harper & Scinto

(57) ABSTRACT

An image forming apparatus has a fixing apparatus 9 that performs electromagnetic induction-heating due to an operation of magnetic fluxes emitted from a magnetic flux generating unit, and a high-frequency power supply circuit which supplies a high-frequency current to the magnetic flux generating unit. The high-frequency power supply circuit is disposed in a casing frame of a main body of the apparatus.

7 Claims, 7 Drawing Sheets

U.S. PATENT DOCUMENTS

2006/0204292 A1 9/2006 Kato et al. ..... 399/328

FOREIGN PATENT DOCUMENTS

JP 8-101546 4/1996
JP 11-186767 7/1999
JP 2001-100477 4/2001
JP 2003069243 * 3/2003
JP 2003-338365 11/2003

* cited by examiner

IMAGE FORMING APPARATUS WITH CASING HAVING METAL PLATES ON EACH PERIPHERAL SIDE

BACKGROUND OF THE INVENTION

1. Field of the Invention

The present invention relates to an electrophotographic type image forming apparatus, such as a full-color printer, or the like, more specifically relates to an image forming apparatus having a toner image forming unit that forms a not-yet-fixed image on a recording material, and a fixing apparatus that performs electromagnetic induction-heating due to an operation of magnetic fluxes generated by a magnetic flux generating unit, in order to fix the not-yet-fixed toner image on the recording material.

2. Description of Related Art

In the electrophotographic type image forming apparatus, an exposure unit exposes a photosensitive drum charged by a charging unit to thereby form an electrostatic latent image, and a developing unit develops the electromagnetic latent image to thereby form a toner image, a transfer unit transfers the toner image on to a recording material, and a fixing apparatus heats and presses transferred recording material to thereby fix the toner image on to the transfer material. This fixing unit has a fixing roller contacting the toner image on the recording material, and a pressure roller forming a nip while contacting the fixing roller, which nips and conveys the recording material.

This fixing roller has been generally of a halogen heater-used heating type; however, in these days, an electromagnetic induction heating type fixing roller has been manufactured for generating an eddy current due to magnetic fluxes to thereby generate heat, as described in Japanese Patent Application Laid-open No. 62-150371.

This electromagnetic induction heating type fixing unit is an apparatus which is to subject an electromagnetic induction heating member to a magnetic field using a coil to thereby generate an eddy current, and which heat-fixes a not-yet-fixed toner image onto a recording material by using the electromagnetic induction heating member and applying heat onto the recording material as a material to be heated with Joule's heat based on the eddy current.

Inducing electromagnetic induction separately requires a high-frequency power supply circuit for passing an alternation current through the coil.

FIG. 7 is a block diagram schematically showing an arrangement of an induction heating apparatus using a high-frequency power supply circuit.

Generally, in a high-frequency power supply circuit 900, because it is necessary to switch a large amount of power at a high speed, there are employed resonant type inverter switching element, which makes it possible to reduce a switching power loss occurring when switching elements is turned on or turned off. This resonant inverter type switching element realizes zero-cross switching by the use of a resonance phenomenon between a resonant coil (induction heating coil) and a resonant capacitor.

In FIG. 7, reference numeral 9*a* designates a fixing roller; 900, a high-frequency power supply circuit; and 9*c*, an induction heating coil for inducing an induced current on the fixing roller 9*a*. Reference symbol TH1 designates a temperature sensor for detecting a temperature of the fixing roller 9*a*.

The above-mentioned high-frequency power supply circuit 900 is constituted of a rectifying circuit 200 comprising diodes D1 to D4 for rectifying an alternating current power supplied from a power supply, a capacitor C1 connected between a noise filter NF1 which is connected to output terminals of the rectifying circuit 200, a capacitor C2 parallelly connected to the induction heating coil 9*c*, a electric power switching element TR1 (constituted by IGBT) connected to induction heating coil L1 in series, a diode D5 parallelly connected to the electric power switching element TR1, and a resonant control circuit IC1 for receiving a signal output from a temperature detecting circuit 7 based on a signal detected by the temperature sensor TH1, and outputting a control signal to the electric power switching element TR1. Further, the resonant control circuit IC1 is constituted by a one-shot pulse generating circuit 110, and a comparison circuit 130 for comparing an output signal of the one-shot pulse generating circuit 110 with an output signal of the temperature sensor TH1. Using such a high-frequency power supply circuit 900 enables a high-frequency alternating current power to be generated A description will be given of an operation of the induction heating apparatus constructed as above.

When it receives a heating command signal, the high-frequency power supply circuit 900 generates a high-frequency alternating current power of about 20 to 100 kHz at its output terminal, thereby causing the coil 9*c* to receive an alternating current power to thereby generate an alternating magnetic field.

On this occasion, the alternating current power applied to the coil 9*c* is usually about 200 to 300 W, and possibly several KW at most, which are, however, varied depending on the size of the fixing roller 9*a*. An alternating magnetic field generated on the above-mentioned coil 9*c* due to the alternating current power applied thereto causes the fixing roller 9*a* to generate an eddy current to generate heat. This heat generation of the fixing roller 9*a* due to the electromagnetic induction operation causes the fixing roller 9*a* to increase in temperature.

Here, the temperature sensor TH1 for measuring the temperature of the fixing roller 9*a* monitors the temperature increasing of the heating roller as needed, and then the detected temperature of the fixing roller 9*a* is fed back to the resonance control circuit IC1. The above-mentioned induction heating power supply 1 compares the detected temperature with a predetermined target temperature, and hence makes the temperature of the fixing roller 9*a* constant in a proportional control manner or a commonly called PDI control manner of reducing the high-frequency electric power as the detected temperature comes close to the predetermined target temperature. Use of such a high-frequency power supply circuit 900 provides the induction heating.

However, the high-frequency power supply circuit 900 emits radiation noises because it passes a high-frequency alternating current through the coil. The radiation noises transmit from a print wiring pattern of a circuit and the like directly to a space and that out of such noises, their high-frequency components are easily transmitted; therefore, high-frequency power supply circuits as described above unfavorably transmit radiation noises more than usual circuits.

To this end, when an electromagnetic induction heating type fig apparatus is employed, surrounding the high-frequency power supply circuit using a metal box makes it possible to reduce the radiation noises.

But, even if a method of surrounding the high-frequency power supply circuit using the metal box is used, the radiation noises unfavorably leak from openings of the metal box through which cables electrically connect between the high-frequency power supply circuit and the coil, and possibly from their terminals disposed at the outside of the metal box.

SUMMARY OF THE INVENTION

It is, therefore, an object of the invention to reduce radiation noises leaking from a high-frequency power supply circuit to outside of the image forming apparatus.

It is another object of the invention to provides an image forming apparatus an image forming apparatus comprising a magnetic flux generating unit which has a coil and generates magnetic fluxes by current passing through the coil; an image heating member which has an electrically conductive layer and generates heat due to an eddy current which is generated due to the magnetic fluxes generated by the magnetic flux generating flux; an image heating means which has the image heating member, and heats an image on a recording member; a casing that contains at least the image heating means; and an electric circuit board which has an electric circuit that forms a high-frequency alternating current passing through the coil, wherein the electric circuit board is contained inside of the casing, and surrounded by metal plates attached to sides of the casing.

Other objects of the invention can be apparent from the descriptions described below.

DETAILED DESCRIPTION OF THE PREFERRED EMBODIMENTS

The invention will now be described in detail with reference to FIGS. 1 to 6 showing one embodiment thereof.

[Whole Arrangement of Image Forming Apparatus]

Figure 1:
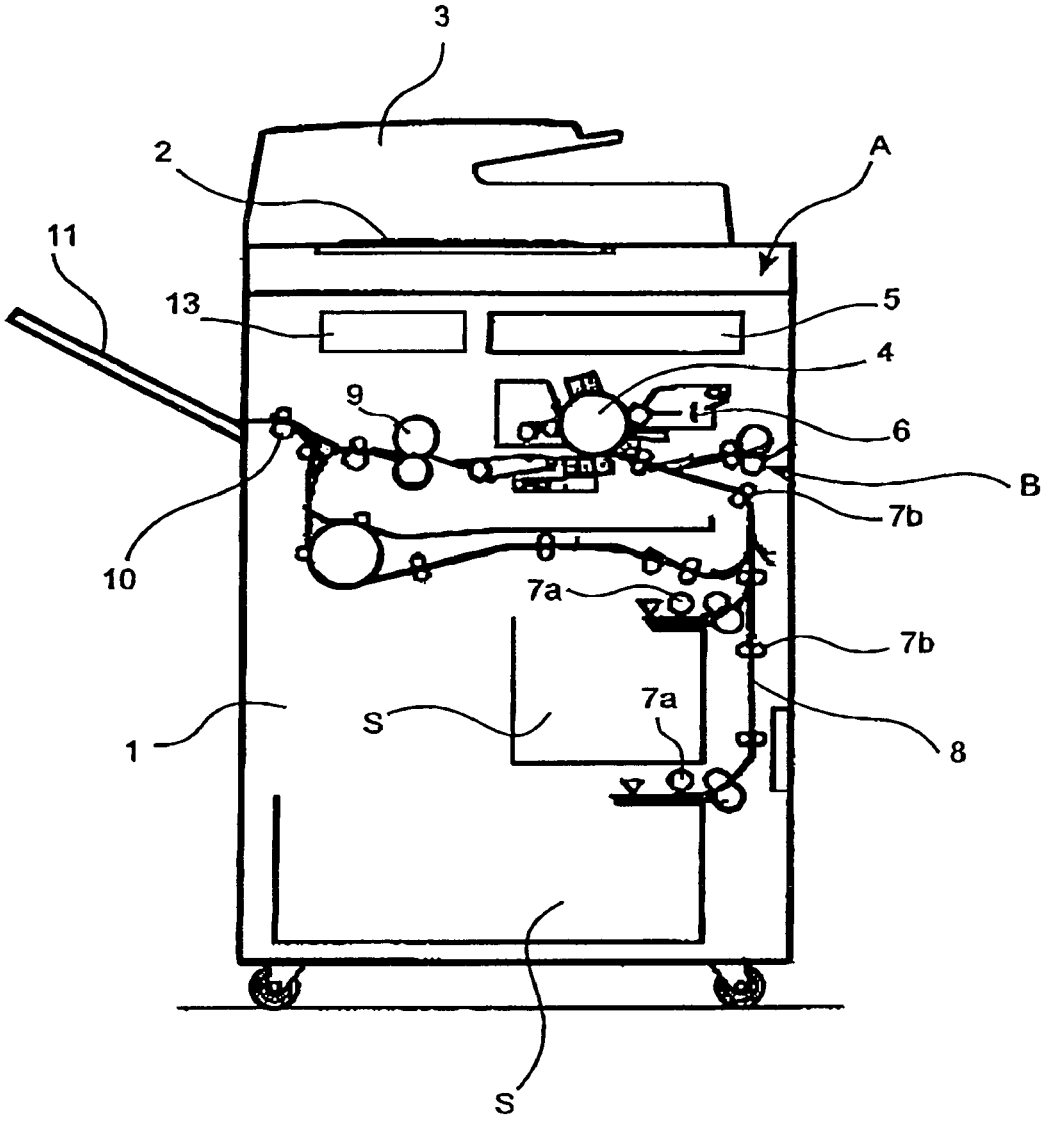
FIG. 1 is a sectional view of an image forming apparatus diagrammatically illustrating its arrangement.

Referring now to FIG. 1, there is illustrated a whole arrangement of an image forming apparatus. Moreover, FIG. 1 is a sectional view of an image forming apparatus diagrammatically illustrating its arrangement.

An image forming apparatus according to the present embodiment comprising an image reading unit A disposed in an upper portion of a main body 1 of the apparatus, for reading an image of an original, and an image forming unit B disposed below the image reading unit A, for forming the image on a recording material. This image forming apparatus has not only a copy function of digital-converting an original information read by the image reading unit A, but also a facsimile function of transmitting the read information to a recording unit of another machine through telecommunication lines for the purpose of image recording.

The image reading unit A has an image reading unit for optically reading an original mounted on a platen glass 2, and an exposing unit for photoelectric-converting and then exposing the read signal on a photosensitive drum 4, as an image bearing member of an image forming unit B. Moreover, there is disposed above the image reading unit A an original automatic feeding apparatus 3 for sequentially feeding a plurality of originals to the platen glass 2.

The image forming unit B records an image on a sheet in an electrophotographic manner. Firstly, a corona charger 20, as a charging unit, charges a surface of a photosensitive drum 4, and secondly, a laser radiating unit 5, as an exposing unit, radiates a laser light on to the photosensitive drum 4 to thereby form an electrostatic latent image, and then the developing unit 6 toner-develops the electrostatic latent image to make the image visible.

Next, feeding rollers 7*a* and conveying rollers 7*b* convey the sheet S as a recording material set at a lower portion of the main body of the apparatus, upward along a sheet conveying path 8 in synchronization with the formation of the toner image, a transfer unit 21 transfers the toner image at the image forming unit B, and further a fixing apparatus 9 as an image heating apparatus, heat-fixes a not-yet-fixed toner image on to the sheet S conveyed thereto, and thereafter, a discharge roller pair 10 discharges the sheet S to an outlet tray 11.

[Electromagnetic Shield of Fixing Apparatus]

The fixing apparatus 9 according to the present embodiment heat-fixes the toner image in an electromagnetic heating manner.

A description will be given hereinbelow of a construction of the fixing apparatus and an electromagnetic shielding construction.

First, a description will be given a casing frame of the main body of the apparatus.

Figure 2:
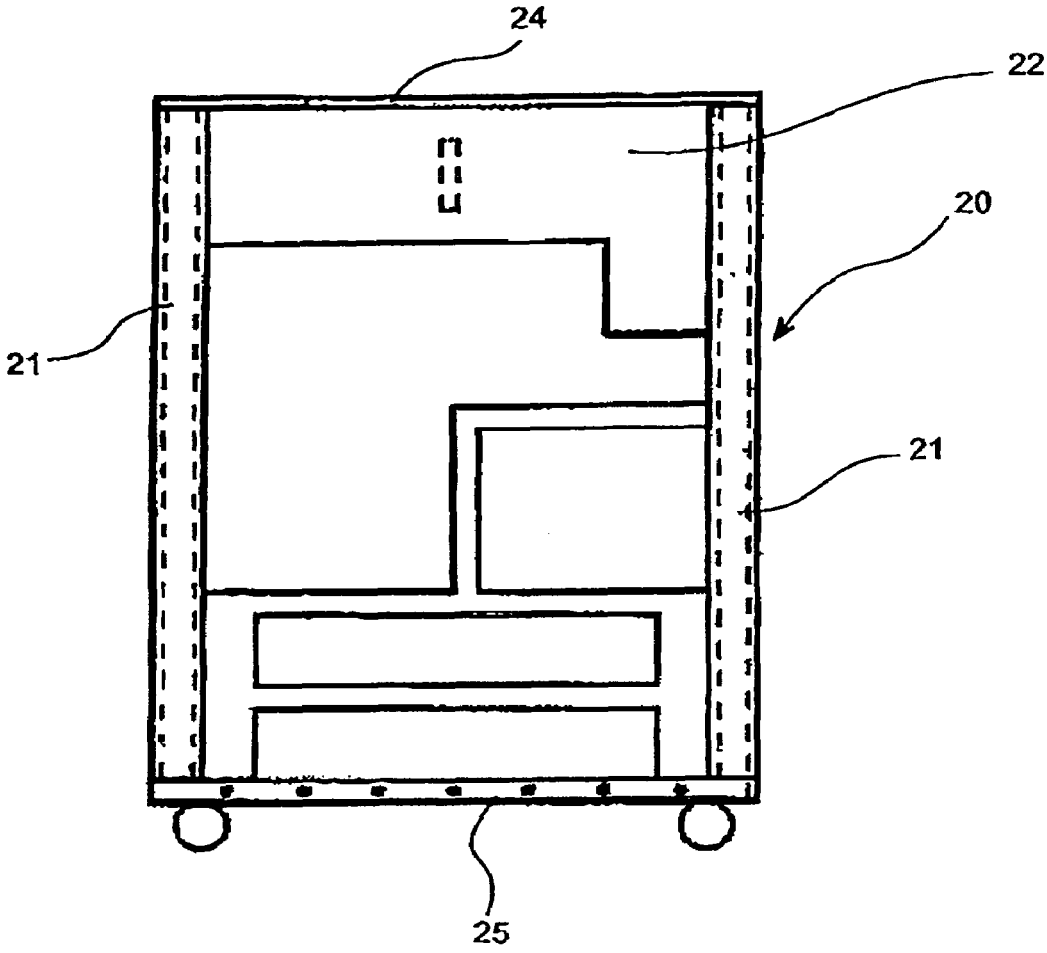
FIG. 2 is a front view of a casing frame in a main body of the apparatus.
Figure 3:
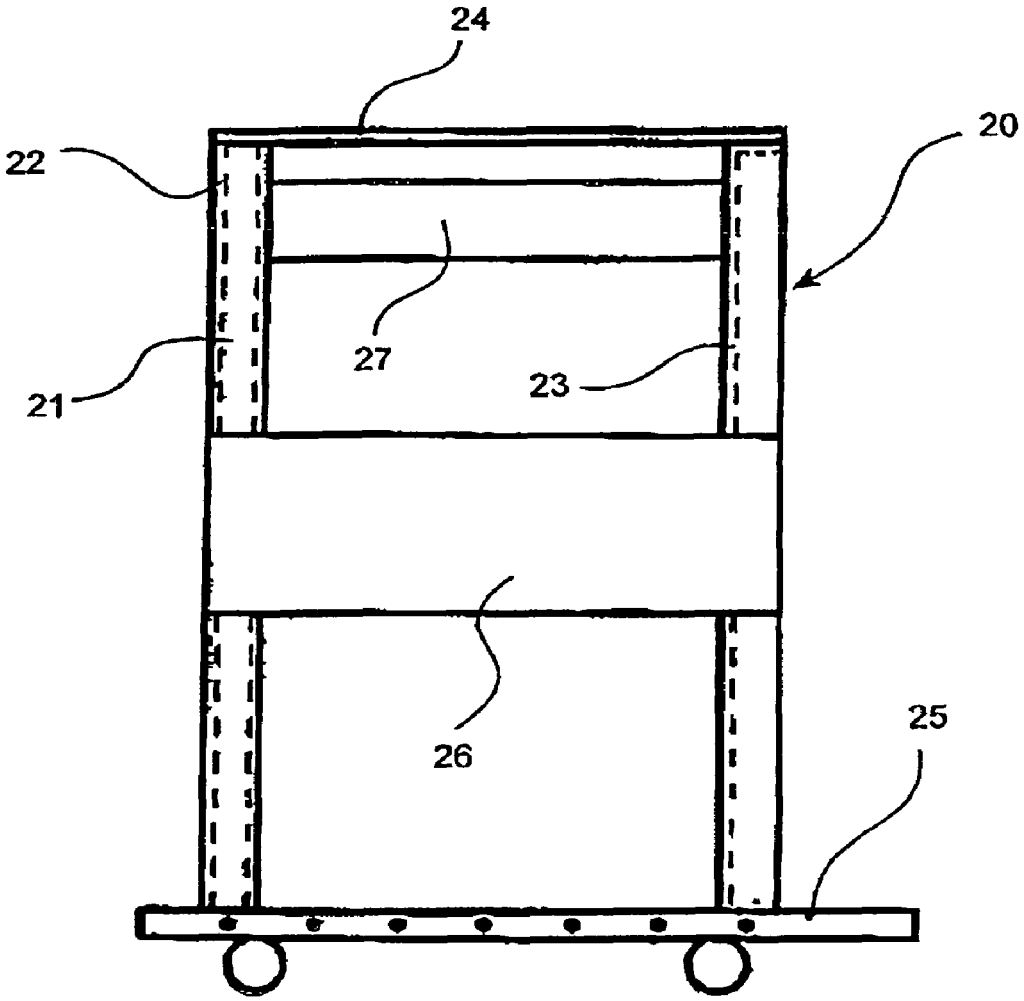
FIG. 3 is a right-hand side view of the casing frame.

FIG. 2 is a front view showing a casing frame in a main body of the apparatus, and FIG. 3 is a right-hand side view of the casing frame.

The casing frame 20 according to the embodiment is formed in a rectangular parallelepiped manner as a whole, and has columns 21 standing upright at its four corners, a front side plate 22 at a front side thereof and a rear side plate 23 at a rear side thereof, a top plate 24 at an upper portion thereof, and a bottom plate 25 at a bottom portion thereof. The front plate 22, the rear side plate 23, the top plate 24, and the bottom plate 25 are adapted to connect the columns 21 to one another. Further, reinforcing stays 26 and reinforcing plates 27 are disposed at both side portions of the casing frame 20 in order to reinforce the columns 21.

The front side plate 22, the rear side plate 23, the top plate 24, the bottom plate 25, the stay 26, and the reinforcing plate 27 each are made of a plastic-formed metal plate, and the columns 21 each are made of a metal pipe or a metal plate member bent like a pipe.

Figure 4:
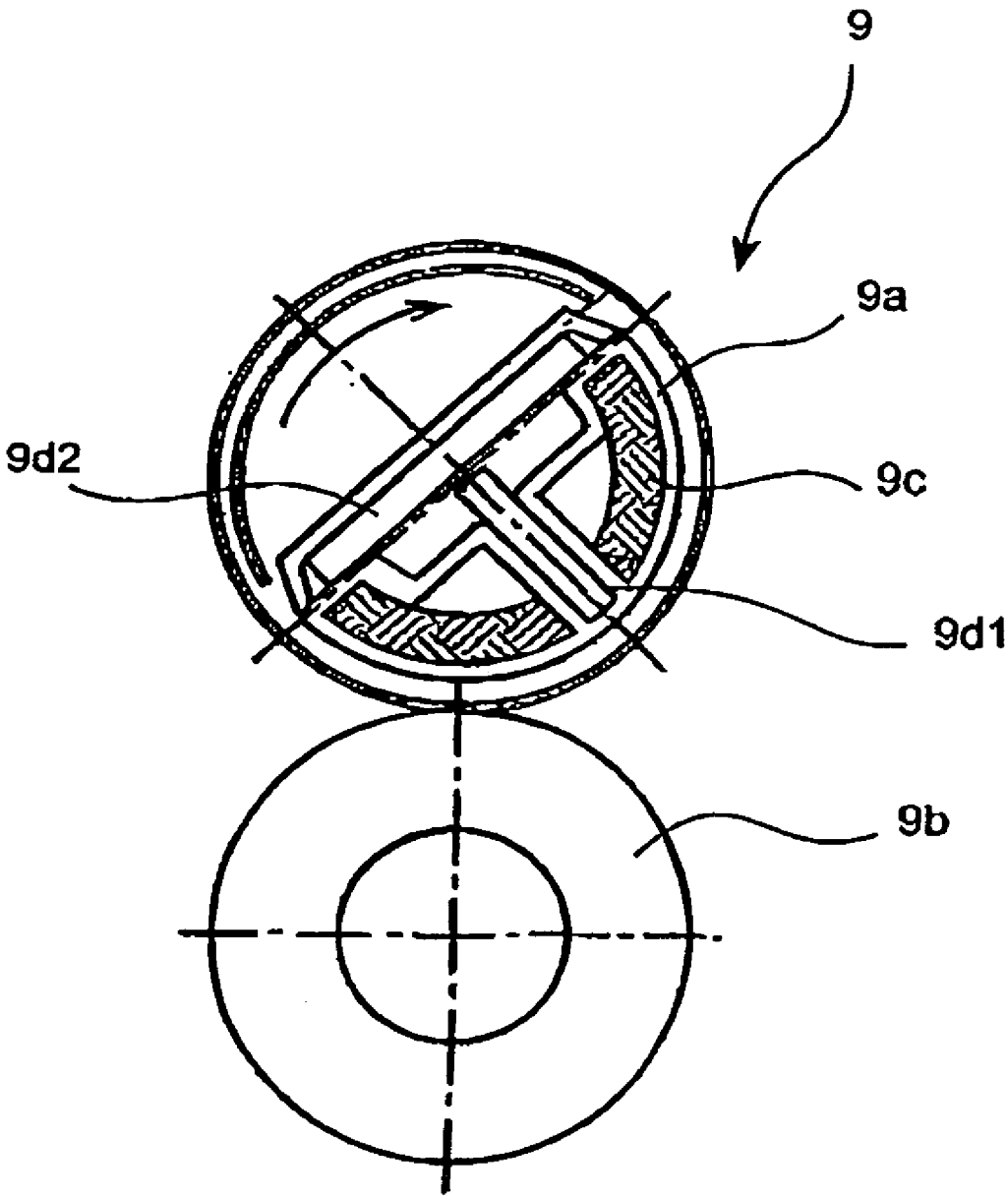
FIG. 4 is a sectional view of a fixing apparatus.
Figure 5:
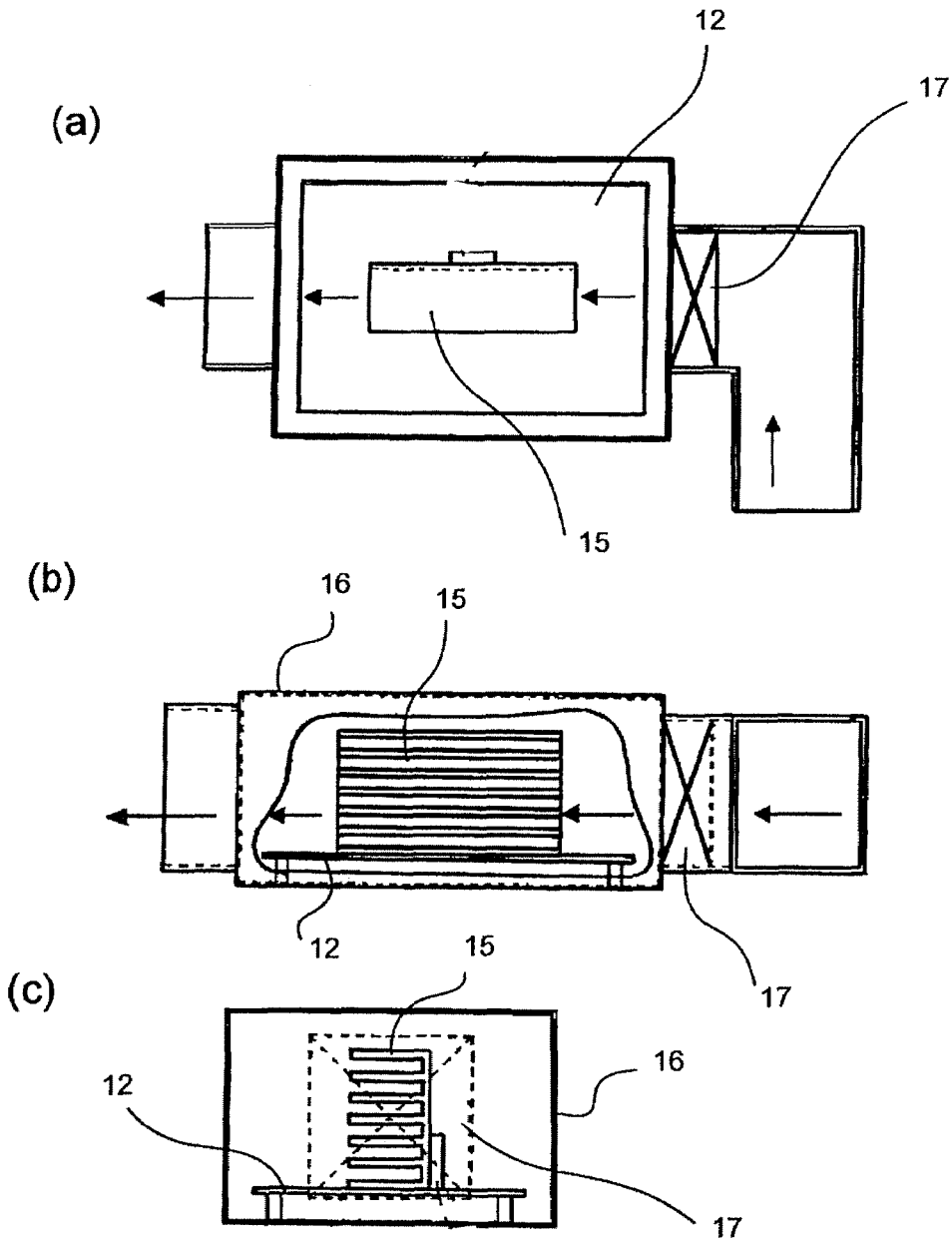
FIG. 5A is a top plan view of an IH power supply unit.
FIG. 5B is a bottom view of the IH power supply unit.
FIG. 5C is a right-hand side view of the IH power supply unit.

Referring next to FIGS. 4 and 5, there is illustrated the fixing apparatus 9 according to the present embodiment.

Figure 6:
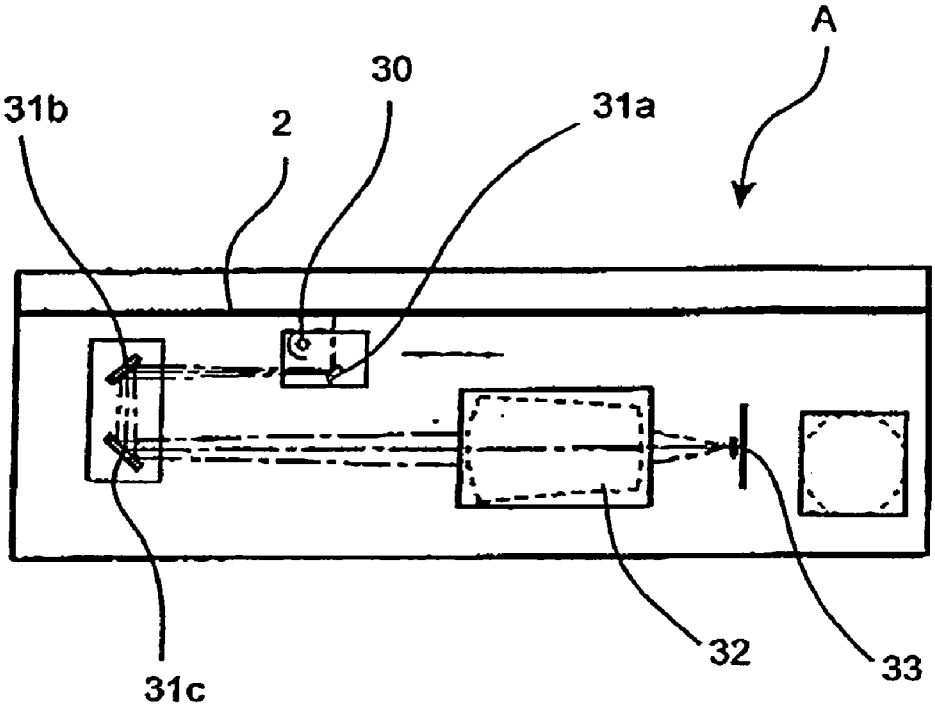
FIG. 6 is a view which is useful in explaining a developing and reading unit.
Figure 7:
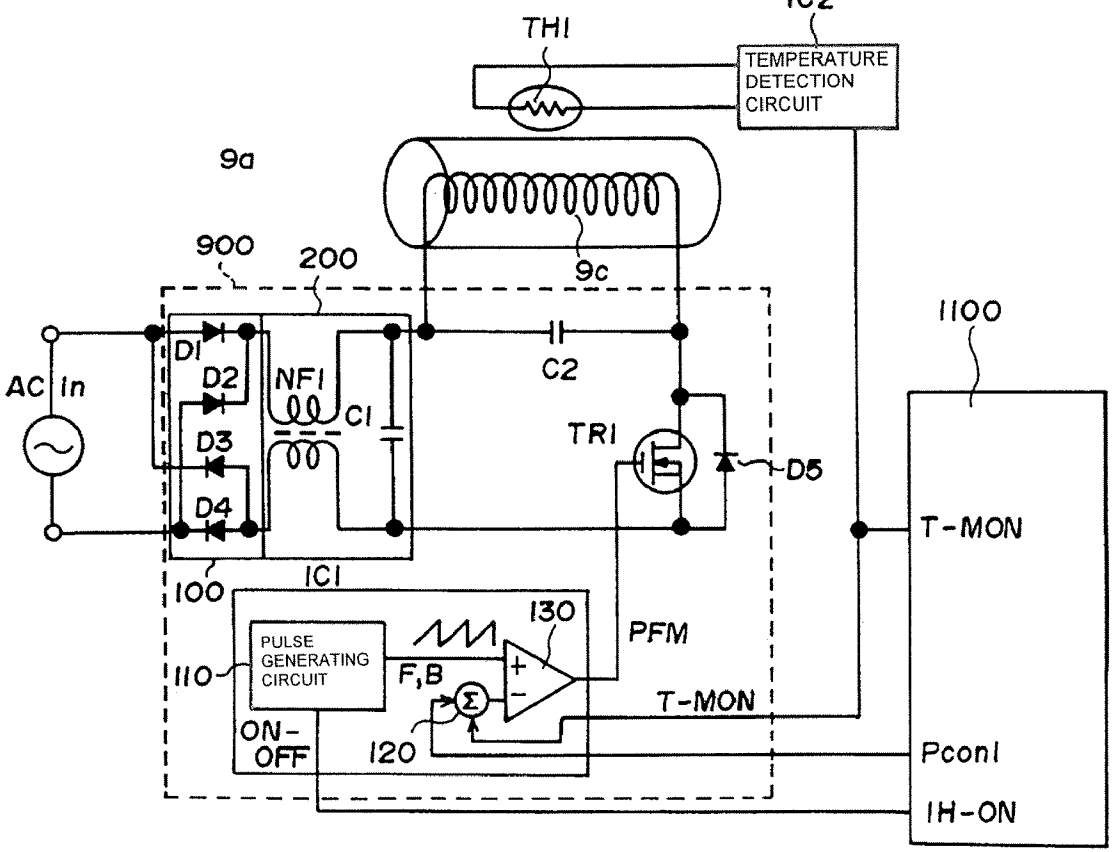
FIG. 7 is a block diagram showing an arrangement of an electromagnetic induction heating apparatus using a high-frequency power supply circuit.

FIG. 4 is a sectional view of the fixing apparatus, FIG. 5A is a top plan view of an IH power supply unit, FIG. 5B is a bottom view of the IH power supply unit; and FIG. 5C is a right-hand side view of the IH power supply unit, FIG. 6 is an explanatory view of a developing and reading unit, and FIG. 7 is a block diagram showing an arrangement of an electromagnetic induction heating apparatus using a high-frequency power supply circuit.

The fixing apparatus 9 is, as shown in FIG. 4, constituted of a fixing roller 9*a* as an image heating member, having an electrically conductive layer for generating heat, and a pressure roller 9*b* as a pressure member, pressure-contacting the fixing roller 9*a* to nip and convey a recording material. Then, the fixing roller 9*a* is made of a electrically conductive metal such as iron and the like and is adapted to generate heat in an electromagnetic manner due to an operation of magnetic fluxes generated by a magnetic flux generating unit described later. Further, the fixing roller 9*a* has a fluorocarbon polymer layer with a high mold-releasing property at a surface thereof A description will be given of a magnetic flux generating unit disposed inside of the fixing roller 9*a*.

This magnetic flux generating unit comprises a coil 9*c*, and cores 9*d*1, 9*d*2 disposed in the vicinity of the coil 9. The coil 9*c* is low in resistance, and high in inductance. Also, it is recommended that each of the cores **9*d*1, 9*d*2** is made of a material, such as ferrite and the like of a low permeability residual magnetic flux density.

Moreover, in this embodiment, a core of the coil **9*c*** is made of a litz wire comprising a bundle of about 80 to 160 thin lines, each of which has a diameter of 0.1 to 0.3 mm.

The high-frequency power supply circuit as an electric circuit board, having an electric circuit generating a high-frequency alternating electric current which applies current to the coil passes an alternating electric current through the coil **9*c*, which allows the coil 9*c* to generate magnet fluxes to subject the fixing roller 9*a* to an electromagnetic induction heating. Moreover, in the fixing apparatus 9 according to the embodiment, the alternating electric current passing trough the coil 9*a*** is 10 to 100 kHz in frequency.

The high-frequency power circuit 12 is disposed in an IH power supply case 13. The IH power supply case is at a portion near below the image forming unit A and above the image forming unit B, in this embodiment, above the fixing apparatus 9.

In this embodiment, the high-frequency power supply circuit and the fixing apparatus are disposed closely to each other in order to shorten a cable connecting the high-frequency power supply circuit and the coil.

Further, other power supplies and electric circuit board for driving the image forming apparatus need not conform in arrangement to the above-mentioned high-frequency power supply circuit.

In the case of the IH power supply case 13, the high-frequency power supply circuit 12 converts an alternating current (50 to 60 Hz), which is supplied from the commercial power source, to a high-frequency alternating current to pass it through the above-mentioned coil. This high-frequency power supply circuit 12 and the coil **9*c*** are connected to each other through a cable.

An IH power supply circuit will now be described with reference to FIG. 7.

Referring to next FIG. 7 of a concept block diagram, there is illustrated an electromagnetic induction heating apparatus according to the invention.

In FIG. 7, reference symbol TR1 designates a electric power switching element such as a MOS-FET, and the like; C2, a resonate capacitor for shaping a high-frequency alternating current, which is applied to the coil **9*c*, as a load, into a resonate waveform; and D5, a flywheel diode parallelly connected to the electric power switching element TR1**, for regenerating an accumulated electric power.

Reference symbol TH1 designates a temperature detecting element (a temperature detecting unit) which is disposed so as to be opposed to the most significant heat radiation portion of the fixing roller **9*a*. A temperature-sensitive element such as a so-called thermistor is used as the temperature detecting element TH1, its output is input to the temperature detecting circuit IC2**.

The temperature detecting circuit IC2 outputs a change of the temperature-dependent resistance of the temperature detecting element TH1 as a voltage value which is represented by a temperature signal T-MON. This temperature signal T-MON are input to an electric power control circuit (a power supply control unit) 1100, and the resonant control circuit IC1 of the high-frequency power supply circuit 900. This electric power control unit 1100 determines, based on its operation condition, an electric energy (hereinafter referred to as "the electric power command value Pcont") to the fixing roller **9*a*** during energization. This electric power command value Pcont is determined based on the operation condition of the image forming apparatus, and changed as occasion demands.

The resonant control circuit IC1 has a one-shot pulse generating circuit 1100, a calculation circuit 120, and a comparison circuit 130. The temperature signal T-MON and the electric power command value Pcont output from the electric control unit 1100 are input. Further, an operation-enabling signal IH-ON output from the electric control circuit 1100 the one-shot pulse generating unit 1100 is input.

On this occasion, the electric power command value Pcont input from the electric control unit 1100 to the resonant control circuit IC1 is input to a pulse frequency modulation (hereinafter referred to as "PFM") oscillating circuit.

The resonant control circuit IC1 generates a PFM pulse corresponding to a value of the electric control signal value to output it to a gate of the electric power switching element TR1, and then switches and drives the electric power switching element TR1.

The high-frequency power supply circuit will be described hereinbelow.

The electric power input from the commercial alternating power supply AC is rectified by a rectifying circuit 100 which is constituted by the mutually bridge-connected diodes D1 to D4, and then smoothed to a direct-current by a smoothing circuit 200 comprising a noise filter NF1 and a smoothing capacitor C1. The noise filter NF1 and the smoothing capacitor C1 have, respectively, such constants as to attenuate the current significantly as to a frequency of the electric power switching element TR1 and causing the current to pass therethrough without attenuation as to a frequency of the power supply. Moreover, the high-frequency power supply circuit 900 is constituted by the rectifying circuit 100, the smoothing circuit 200, the resonant capacitor C2, and the resonant control circuit IC1.

After receiving a heating signal at the time of starting the copying operation, the electric power control circuit 1100 outputs the operation-enabling signal IH-ON and the electric power command value Pcont to the resonant control circuit IC1 of the high-frequency power supply circuit 900 and error detecting circuit 111 corresponding to a condition of the copying operation.

When an alternating current input voltage is applied to an input terminal of the high-frequency power supply circuit 900 during the above-mentioned operation, the alternating current is rectified by the rectifying circuit 100 of the diodes D1 to D4 and then applied as a pulsating flow to both ends of the capacitor C1 through the noise filter NF1 in the rectifying circuit 200. As a result, the voltage between the both ends of the capacitor C1 has such a waveform as that the alternating current is rectified.

The electric power control circuit 1100 applies, to the resonant control circuit IC1, the electric power command value Pcont as a control signal, according to the operation condition of the apparatus. The resonant control circuit IC1 generates PFM pulses corresponding to the electric power command value Pcont. The electric power switching element TR1 receives the PFM pulses generated by the resonant control circuit IC1 between a gate and a source thereof to thereby be switched over, which causes a drain current ID to pass through the coil **9*c***.

The coil **9*c* accumulates the current passing therethrough when the electric power switching element TR1 is turned on, and hence generates a back electromotive force when the electric power switching element TR1 is turned off, thereby causing the current accumulated in the coil to be charged in the resonant capacitor C2, which increases the charged voltage of the resonant capacitor C2**.

Further, the current passing through the coil **9*c* attenuates inversely proportional to an increase of the voltage of the resonant capacitor C2, thereby disabling the current to pass through the coil 9*c* over a predetermined voltage of the resonant capacitor C2. Thereafter, the electric charge accumulated in the resonant capacitor C2 allows the current to pass through the induction heating coil L1**.

Thereafter, the electric charge accumulated in the resonant capacitor C2 returns to the coil 9*c*, and simultaneously the resonant capacitor C2 decreases in voltage. Accordingly, the electric power switching element TR1 decreases in its drain voltage lower than in its source voltage, which causes the flywheel diode D5 to turn on to allow the forward current to pass therethrough.

Then, when the electric power switching element TR1 turns on again, the current passes through the coil 9*c*, and then accumulated in the coil 9*c*, followed by repeating these operations. As a result, the induction current passes through the fixing roller 9*a* as a load which is opposed to the coil 9*c* and connected to the coil 9*c* in an electromagnetic manner, thereby causing the fixing roller 9*a* made of an electrically conductive material to generate Joule's heat obtained by multiplying its own resistance value with the square value of the induction current, which causes the inside of the fixing roller to generate heat efficiently. This enables the whole fixing roller 9*a* rotating to be heated.

Moreover, the capacitor C1 smoothes the current passing through the electric power switching element TR1 and the coil 9*c*, while charging and discharging its high-frequency component. Therefore, the high-frequency current does not pass through the noise filter NF1, but only the rectified current passes therethrough.

The smoothing circuit 200 comprising the capacitor C1 and the noise filter NF1 filters the waveform of the current passing through the electric power switching element TR1 and the induction heating coil L1, thereby decreasing the high-harmonic component of the input current significantly, therefore, waveform of the alternation input current before rectification come to be the waveform of the alternation input current close to that of the alternation input voltage, which results in the improvement of a power factor of the input current of the smoothing circuit 200.

Further, any other means can be employed as the smoothing circuit 200 comprising the noise filter NF1 and the capacitor C1 insofar as it is capable of achieving a filtering effect to the oscillating frequency with high frequency due to the resonant control circuit IC1. This reduces the capacitance of capacitor C1 and the inductance of the noise filter NF1, with a miniaturized and weight-saved smoothing circuit 200.

Inputting an electric power temperature control signal to the high-frequency power supply circuit causes a high-frequency alternating current electric power of about 20 KHz to 1 MHz to be generated at an output terminal of the induction heating power supply circuit.

On this occasion, an output of the temperature detecting element TH1 for detecting the temperature of the surface of the fixing roller is input, as needed, through the temperature detecting circuit IC2 to the electric control circuit 1100 as a temperature signal T-MON. Then, the detected temperature is compared with a heating target temperature as needed, and then the compared difference with the target value is fed back to the resonant control circuit IC1 as an electric power command value Pcont.

The electric power circuit 1100 generates a feed back signal of making the temperature of the surface of the fixing roller constant in a proportional control manner, and the like or a commonly called PDI control manner of reducing the high-frequency electric power as the detected temperature detected by the temperature detecting circuit IC 2 comes close to the predetermined temperature information. The resonant control circuit IC1 receives the heating target temperature-dependent difference detected by the electric control circuit 1100, that is, the electric power command value Pcont, determines a gate ON signal time period of the electric power switching element TR1 according to the electric power command value Pcont, and adjusts the energizing electric power of the electric power switching element TR1. This enables the electric power input to the coil 9*c* to be controlled, thereby causing the heat release amount of the fixing roller to be controlled, which results in the stabilization of the toner fixing temperature.

The above-mentioned high-frequency power supply circuit is a source of high-frequency noises. Therefore, in this embodiment, the above-mentioned IH power supply case 13 is disposed between the front side plate 22 and the rear side plate 23 as the casing frame of the main body 1 of the apparatus. These side plates 22, 23, made of metal arranged in front of and in back of the IH power supply 13 carry out a shielding function, thereby reducing radiation noises. Further, in this embodiment, on a right-hand side and a left-hand side of the IH power supply 13 are also disposed reinforcing metal stays 26 and reinforcing metal plates 27 for the casing frame which carries out a noise shielding function, thereby reducing noises.

Further, at the junction of the cable electrically connecting the high-frequency power supply circuit and the coil with the high-frequency power supply circuit is also surrounded by the side plates, thereby capable of reducing radiation noises.

In this way, surrounding the high-frequency electric power circuit by the metal side plates disposed on the casing prevents the high-frequency noises from leaking to outside of the image forming apparatus irrespective of how to connect the high-frequency power supply circuit and the connecting units.

The metal side plates functioning as noise shielding requires that the side plates each are made of a high electrically conductive material. In this embodiment, it is iron. However, the same effect can be achieved so long as it is a high electrically conductive material such as copper, and the like.

Besides, by making the respective side plate such a size as to surround a cable portion of electrically connecting the coil and the high-frequency power supply circuit, it is capable of further reducing the leakage of noises radiating from the cable to outside of the image forming apparatus.

Further, in this embodiment, as shown in FIG. 5, the above-mentioned high-frequency power supply circuit 12 is disposed in an IH power supply box 16 which is grounded and surrounded by a general metal casings. In this embodiment, since the high-frequency power supply circuit 12 which radiates high-frequency noises are thus surrounded by general metal members, and further the IH power supply box 16 is disposed in the metal casing from the main body of the apparatus, it is capable of improving an electromagnetic shielding effect significantly. The IH power supply box 16 is required to be made of a high electrically conductive material. In this embodiment, it is iron.

Then, since the casing frame of the main body of the apparatus is electrically earthed, it is capable of usually achieving a stable shielding effect.

When the above-mentioned high-frequency power supply circuit 12 is disposed above the fixing apparatus, it is apt to extremely rise highly in temperature, and that the temperature increasing rate is extremely high. To this end, in this embodiment, a heat sink 15 as a radiating unit is disposed for the purpose of heat-releasing the high-frequency power supply circuit 12 as shown in FIG. 5.

Further, a fan 17 is disposed adjacently to the heat sink 15 in the IH power supply case 13, for allowing air to flow toward the heat sink to thereby cool it as shown by arrows. This fan 17 forms airflow inside the IH power supply case 13 so as not to accumulate heat within the IH power supply case 13.

In this embodiment, the fixing roller is described, however, the fixing roller is replaced with an induction heating type belt having an electrically conductive layer.

[Arrangement of High Frequency Power Supply Circuit to Image Reading Section]

Next, a description will be given of a relationship between the above-mentioned high-frequency power supply circuit 12 and the image reading unit A as the image reading apparatus. When reading an image, a light source 30 radiates a light on to an original set on the platen glass 2 of the image reading unit A, as shown in FIG. 6. Then, a reflected light from the original is led to a CCD 33 through mirrors 31*a* to 31*c* and a lens 32, and then the reflected light is converted into a digital signal.

On this occasion, at the time of start-up under a high-humidity environment or a low-temperature environment, heat emitted from the light source 30 causes the surfaces of the mirrors 31*a* to 31*c* to be warmed rapidly, and further it takes 30 minutes or more to warm the whole mirrors 31*a* to 31*c* because the heat emitted from the light source 30 is small in quantity. To this end, the heat emitted from the light source 30 may cause condensation on the surfaces of the mirrors 31*a* to 31*c*.

Then, when starting up the image reading operation with condensation on the surfaces of the mirrors 31*a* to 31*c*, the reflected light is irregularly reflected on the surfaces of the mirrors 31*a* to 31*c*, thereby making it difficult to input the normal reflected image into the CCD 33. Accordingly, during a time period between the time the condensation occurs and the time the condensation evaporates, that is, during 10 to 30 minutes from the start-up, the copy image easily deteriorates in reading quality.

In the case of an analogue copying machine, it is impossible to dispose the image reading unit A and the image forming unit B separately; however, the heat emitted from the fixing apparatus in the image forming unit B makes it easy to prevent condensation from occurring. On the other hand, in the case of a digital multifunction imaging apparatus, because the image reading unit A and the image forming unit B are disposed separately, the heat emitted from the fixing apparatus is difficult to be transmitted to the image reading apparatus A, which makes it difficult to prevent condensation from occurring.

To this end, a plurality of condensation preventing heaters are conventionally disposed in the vicinity of the mirrors 31*a* to 31*c* in order to prevent the condensation from occurring. However, in this embodiment, the IH power supply case 13 is disposed in the vicinity of the lower portion of the image reading unit A, that is, in the vicinity of the lower portion of the mirrors 31*a* to 31*c*, and hence use of the heat prevents the condensation from occurring.

Then, the heat sink 15 is disposed in the vicinity of the top plate 24 between the image reading unit A and the image forming unit B, thereby causing the heat emitted from the heat sink 15 to be easily transmitted to the image reading unit A, which makes it difficult to cause condensation even if a heating heater is not provided exclusively for the image reading unit. This reduces the number of parts and provides cost down.

As described above, according to the invention, it is possible to prevent the radiation noises from leaking to outside of the image forming apparatus, irrespective of how to connect the coil and the high-frequency power supply circuit.

The embodiment of the invention is described above in detail, however, the invention may not be restricted to the embodiment. The invention can be variously modified so long as they are not deviated from the technical idea of the invention.

CROSS-REFERENCE TO RELATED APPLICATION

This application claims the benefit of priority from the prior Japanese Patent Application No. 2004-308014 filed on Oct. 22, 2004 the entire contents of which are incorporated by reference herein.

What is claimed is:

1. An image forming apparatus comprising:

a magnetic flux generating unit which has a coil and generates magnetic fluxes by current passing through said coil;

an image heating member which has an electrically conductive layer that generates heat due to an eddy current which is generated due to said magnetic fluxes generated by said magnetic flux generating unit;

an image forming means for forming an image on a recording material;

an image heating unit which has said image heating member, and heats an image on a recording member;

an electric circuit board which has an electric circuit that forms a high-frequency alternating current passing through said coil and is located above the image heating unit;

a casing with corners having a column located near each of its corners, which surrounds a space in which said image forming means, said image heating unit and said electric circuit board are located; and a plurality of metal plates which are attached to each peripheral side of said casing and are supported by the columns;

wherein each distance between each column is greater than each length of the electric circuit board facing each metal plate in a horizontal direction, and said plurality of metal plates are positioned to overlap said electric circuit board.

2. An image forming apparatus according to claim 1, wherein said electric circuit board is covered by another metal plates inside of said casing.

3. An image forming apparatus according to claim 1, wherein said electric circuit board is disposed in the vicinity of said image heating unit.

4. An image forming apparatus according to claim 2, wherein said apparatus has an original reading unit which reads an original, and said electric circuit board is disposed between said image heating unit and said original reading unit.

5. An image forming apparatus according to claim 1, said electric circuit board is fixed in a box made of metal and said box is disposed in said casing.

6. An image forming apparatus according to claim 5, said box is surrounded by the plurality of metal plates in horizontal direction.

7. An image forming apparatus according to claim 1, further comprising an airflow providing unit which provides airflow toward said electric circuit board.

* * * * *